United States Patent [19]

Morita

[11] 3,986,102

[45] Oct. 12, 1976

[54] LOW LOSS STABILIZED POWER SUPPLY CIRCUIT

[75] Inventor: Takahiko Morita, Sayama, Japan

[73] Assignee: Hitachi Electronics, Ltd., Japan

[22] Filed: July 2, 1974

[21] Appl. No.: 485,283

[30] Foreign Application Priority Data

July 6, 1973 Japan ..... 48-79685[U]

[52] U.S. Cl. ..... 323/22 T; 323/22 Z; 323/38

[51] Int. Cl.[2] ..... G05F 1/56

[58] Field of Search ..... 323/22 T, 22 Z, 17, 323/19, 38

[56] References Cited

UNITED STATES PATENTS

| | | | |
|---|---|---|---|
| 3,005,147 | 10/1961 | Thomas | 323/22 T |
| 3,109,979 | 11/1963 | Faulkner et al. | 323/22 T |
| 3,246,233 | 4/1966 | Herz | 323/22 Z |
| 3,566,254 | 2/1971 | Griffin | 323/22 T |
| 3,873,907 | 3/1975 | Bumgardner | 323/22 T |
| 3,916,294 | 10/1975 | Kennedy | 323/22 T |

*Primary Examiner*—Gerald Goldberg
*Attorney, Agent, or Firm*—Craig & Antonelli

[57] ABSTRACT

A stabilized power supply circuit using a series control transistor is disclosed, in which the base of the series control transistor is connected to the collector of another transistor of the opposite polarity, and the emitter of the second-mentioned transistor is connected through a resistor to a reference voltage setting diode of an error detecting circuit.

4 Claims, 4 Drawing Figures

LOW LOSS STABILIZED POWER SUPPLY CIRCUIT

FIELD OF THE INVENTION

This invention relates to a low loss stabilized power supply circuit using a series control transistor.

DESCRIPTION OF THE PRIOR ART

The stabilized power supply circuit with a battery as a power source which is used for small electronic devices requires no measures against ripple or great variations of input voltage, and therefore a simply constructed circuit is required. Among the various types of circuits in this category, a typical one will be explained with reference to FIG. 1*a*. Reference symbol $Q_1$ shows an NPN transistor for error detection, $Q_2$ an NPN transistor for control purpose, E a power supply, D a Zener diode for setting a reference voltage, $R_1$ to $R_5$ resistors, and $C_1$ a smoothing capacitor. The resistors $R_1$, $R_2$ and $R_3$, transistor $Q_1$ and Zener diode D make up an error detecting circuit.

In the transistorized stabilized power supply circuit with this circuit arrangement, when an output current or the emitter current $I_E$ of the transistor $Q_2$ increases, the base current $I_B$ of the transistor $Q_2$ is also increased with the rate of $I_E/h_{FE}$, where $h_{FE}$ designates a DC current amplification factor. Therefore, when the output current is large, the resistance value of the resistor $R_5$ must be reduced so that the current $I_R$ flowing through the resistor $R_5$ sufficiently increases in order to achieve stable operation. However, the reduction in the resistance value of the resistor $R_5$ is not practically desirable as it necessarily results in the decrease in the loop gain of the stabilization circuit.

Another disadvantage of the foregoing conventional circuit is that the current $I_R$ undergoes great variations in the presence of slight variations in the input voltage.

A basic idea to overcome such a disadvantage may be to replace the controlling transistor $Q_2$ by transistors $Q_2$ and $Q_3$ in Darlington connection as shown in FIG. 1*b*. In this circuit, however, the collector-emitter voltage $V_{CE}$ of the transistor $Q_2$ must be higher than the sum of the base emitter voltages of the transistors $Q_2$ and $Q_3$, that is, $V_{BE2} + V_{BE3}$, and thus must generally be 1.2 to 1.5 volts. As a result, the circuit does not operate when the difference between the output voltage $E_0$ and the input voltage $E_i$ is small, thus making the circuit suitable to the case where a sufficiently high collector-emitter voltage can be obtained. In the latter case, however, an increased power loss is caused due to the transistor $Q_2$, which leads to a wasteful power consumption for an electronic device with a battery as a power supply, making the circuit unsuitable for long continuous operation.

SUMMARY OF THE INVENTION

Accordingly, it is an object of the present invention to provide a low loss stabilized power supply circuit with a simple arrangement which operates stably in spite of a small difference between input and output voltages and which involves a remarkably reduced power loss due to the series controlled transistor.

In order to achieve the above-mentioned object, there is provided according to the invention a stabilized power supply circuit in which the base of a first NPN or PNP controlling power transistor is connected to the collector of a second PNP or NPN transistor of the polarity opposite to that of the first transistor, and the emitter of the second transistor is connected through a resistor to a reference voltage setting diode of an error detecting circuit.

DESCRIPTION OF THE PREFERRED EMBODIMENTS

Figure 1A:
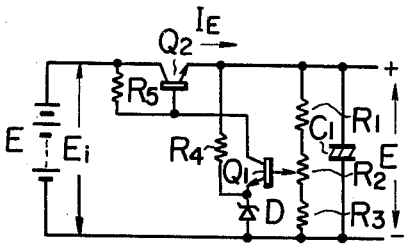
FIG. 1a PRIOR ART
FIG. 1*a* and FIG. 1*b* are diagrams showing conventional stabilized power supply circuits.
Figure 1B:
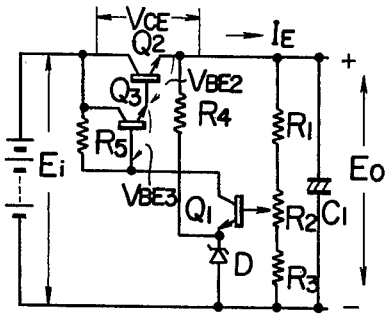
FIG. 1b PRIOR ART
Figure 2:
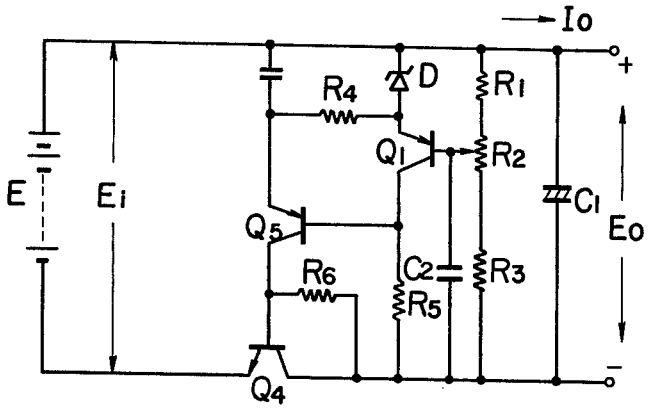
FIG. 2 is a diagram showing a low loss stabilized power supply circuit according to an embodiment of the present invention.

In FIG. 2 showing a low loss stabilized power supply circuit according to an embodiment of the invention, like reference symbols denote like component elements in FIG. 1. Reference symbols $Q_4$ and $Q_5$ show controlling transistors having opposite polarities. The first NPN controlling transistor has its collector connected to the resistor $R_3$ and capacitor $C_1$ and its emitter connected to the negative terminal of power supply E. The second PNP controlling transistor $Q_5$ has its collector connected to the base of the first transistor $Q_4$, its emitter connected to the reference voltage setting Zener diode D through the resistor $R_4$ and its base connected to the collector of the error amplifying PNP transistor $Q_1$ as well as to the collector of transistor $Q_4$ through the resistor $R_5$. The emitter of the PNP transistor $Q_1$ is connected to the positive terminal of the power supply E through the reference voltage setting Zener diode D. Further, the base of the transistor $Q_1$ is connected to the intermediate terminal of the voltage-setting variable resistor $R_2$. One end of the variable resistor $R_2$ is connected through the resistor $R_1$ to the positive terminal of the power supply E, while the other end thereof is connected through the resistor $R_3$ to the collector of the first controlling transistor $Q_4$. Symbol $C_1$ shows a smoothing capacitor connected in parallel to the series resistor circuit comprising resistors $R_1$, $R_2$ and $R_3$, and symbol $C_2$ a ripple-eliminating capacitor.

The operation of the above-described circuit will be explained. The circuit operates to obtain the stabilized output voltage $E_0$ from the input voltage $E_i$ supplied from the power supply E, in which the split ratio of the series resistor consisting of resistors $R_1$, $R_2$ and $R_3$ is changed by adjusting the variable resistor $R_2$, and the output voltage $E_0$ is determined by the split ratio and the Zener voltage of the Zener diode D.

The base current $I_{B_4}$ of the transistor $Q_4$ is expressed as $$I_{B_4} = \frac{I_0}{h_{FE_4}},$$

where $h_{FE_4}$ is the DC current amplification factor of the first controlling transistor $Q_4$ and $I_0$ the output current. Most of the current $I_{B_4}$ becomes the collector current of the second controlling transistor $Q_5$, while a part thereof flows through the starting resistor $R_6$. At the time of starting, the base current of the transistor $Q_4$ is supplied through the resistor $R_6$, but it can be substantially ignored in a stable state. Since $I_{B_4} >> I_{B_5}$, where $I_{B_5}$ shows the base current of transistor $Q_5$, the voltage across the resistor $R_4$ is $R_4 \cdot I_{B_4}$ and therefore the collector-emitter voltage $V_{CE_1}$ of transistor $Q_1$ is expressed as $$V_{CE_1} = R_4 \cdot I_{B_4} + V_{BE_5},$$

where $V_{BE_5}$ is the base-emitter voltage of the transistor $Q_5$.

In order to set the voltage $V_{CE_1}$ in such a range as to enable a linear operation of the transistor $Q_1$, the resistor $R_4$ is determined according to the base current $I_{B_4}$ of the transistor $Q_4$, that is, the output current $I_0$. Generally, the collector-emitter voltage $V_{CE_1}$ of the transistor $Q_1$ should preferably be 2V or higher. The resistor $R_4$ is for biasing as well as protecting the transistor $Q_5$ against an excessive current which may be caused at the output due to a short-circuiting of the load or the like.

Taking the Zener voltage of the Zener diode as $V_Z$, the collector-emitter voltage $V_{CE_5}$ of the transistor $Q_5$ is expressed as $$V_{CE_5} = E_i - V_Z - V_{CE_1}.$$

As a result, the transistor $Q_5$ can be maintained in the linear range in its operation by setting $V_E$ and $V_{CE_1}$ ($V_{CE_1}$ being approximately 2V) at an appropriate level, thus making possible a stable comparison between the reference voltage $V_Z$ and the output voltage $E_0$ as well as a stable amplification made by the transistors $Q_1$ and $Q_5$. Thus, a stabilized operation is assured until the collector-emitter voltage $V_{CE_4}$ of the transistor $Q_4$ reaches the saturation voltage of the transistor $Q_4$, even when there is only a small difference between the input voltage $E_i$ or the source voltage E and the output voltage $E_0$ or when the input voltage $E_i$ drops to such a degree that there is only a small difference between it and the output voltage $E_0$.

It is obvious that the resistor $R_4$ may be replaced by an ordinary impedance element such as a diode without departing from the spirit of the invention. As will be seen from the above description, even when the voltage across the battery, say, 12V to 10.5V is very close to the stabilized output voltage, say, 10V, the stabilized operation is achieved up to the saturation voltage of the controlling power transistor. Therefore, an efficient low loss stabilized power supply circuit is realized even if a large output current, say, 700 mA is involved. This facilitates the improved efficiency of the stabilized power supply circuit for various electronic devices with a battery as a power supply, while at the same time permitting uninterrupted use of such devices for a long period of time.

Figure 3:
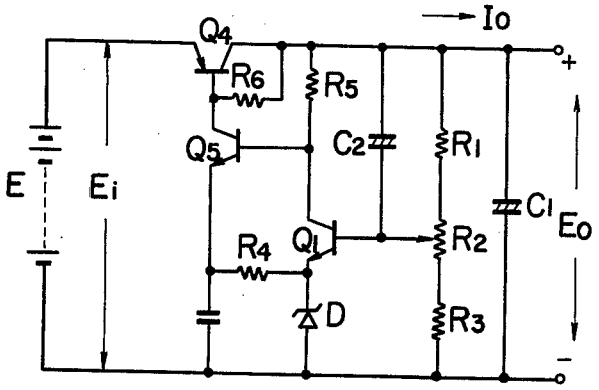
FIG. 3 is a diagram showing a low loss stabilized circuit according to another embodiment of the invention.

Unlike the embodiment of FIG. 2 in which a PNP transistor is used as the transistor $Q_1$, an NPN transistor as the transistor $Q_4$ and a PNP transistor as transistor $Q_5$, an alternative circuit arrangement with the same effect can be provided according to the invention, which employs transistors of opposite polarities to those of the above transistors, respectively, FIG. 3 shows such alternative circuit arrangement.

It will be apparent from the foregoing description that according to the present invention it is possible to obtain a low loss stabilized power supply circuit with a very simple circuit arrangement which operates stably without any complicated means even against a small difference, say, 0.3 V to 0.5 V, between the input and output voltages. Further, the low loss and simple arrangement leads to the advantage of cost reduction. For the reasons mentioned above, the stabilized power supply circuit according to the invention may be applied with great advantage to all battery-operated various electronic devices required to be compact in size and light in weight as well as other electronic devices which involve the problem of loss.

I claim:

1. In a stabilized power supply circuit comprising a series control transistor, an error detecting circuit for detecting variations in the output voltage including a reference voltage setting diode and a voltage dividing circuit connected in parallel with a load, an output of the voltage dividing circuit being compared with the reference voltage, and another transistor of the opposite polarity to said series control transistor, the collector of said another transistor being connected to the base of said series control transistor, the improvement wherein the emitter of said another transistor is connected through a resistor to said reference voltage setting diode.

2. A low loss stabilized power supply circuit comprising a DC power supply, a first control transistor connected in series to said power supply, an error detecting circuit for detecting variations in the output voltage including a reference voltage setting diode and a voltage dividing circuit connected in parallel with a load, an output of the voltage dividing circuit being compared with the reference voltage, and a second control transistor of the opposite polarity to said first control transistor, said second control transistor having its collector connected to the base of said first control transistor, and its emitter connected to said reference voltage setting diode through a resistor.

3. A low loss stabilized power supply circuit according to claim 2, in which said first control transistor has an emitter connected to the negative terminal of said DC power supply.

4. A low loss stabilized power supply circuit according to claim 2, in which said first control transistor has an emitter connected to the positive terminal of said DC power supply.

* * * * *